United States Patent [19]

Rowland et al.

[11] 4,254,005

[45] Mar. 3, 1981

[54] ABRASION RESISTANCE AND STRENGTH OF COTTON-CONTAINING FABRIC MADE RESILIENT WITH N-METHYLOLACRYLAMIDE-TYPE REAGENT

[75] Inventors: Stanley P. Rowland; Florine A. Blouin, both of New Orleans; Frederick F. Shih, Metairie, all of La.

[73] Assignee: The United States of America as represented by the Secretary of Agriculture, Washington, D.C.

[21] Appl. No.: 118,948

[22] Filed: Feb. 6, 1980

Related U.S. Application Data

[62] Division of Ser. No. 8,129, Jan. 31, 1979.

[51] Int. Cl.[3] ..... C08L 61/22

[52] U.S. Cl. ..... 260/29.6 H; 260/29.65 Q

[58] Field of Search ..... 260/29.4 R, 29.6 H, 260/29.6 SQ; 526/MS File

[56] References Cited

U.S. PATENT DOCUMENTS

| | | | |
|---|---|---|---|
| 3,125,405 | 3/1964 | Gardon | 8/184 |
| 3,125,406 | 3/1964 | Herman | 8/184 |
| 3,246,946 | 4/1966 | Gardon | 8/184 |
| 3,262,985 | 7/1966 | Muller et al. | 526/218 |
| 3,322,569 | 5/1967 | Faulhaber et al. | 8/184 |
| 3,558,263 | 1/1971 | Baitinger | 8/184 |
| 3,561,916 | 2/1971 | Baitinger | 8/120 |
| 3,622,261 | 11/1971 | Cotton et al. | 8/187 |
| 3,653,805 | 4/1972 | Gamarra et al. | 8/184 |
| 3,669,609 | 6/1972 | Weyker et al. | 8/120 |
| 3,899,471 | 8/1975 | Lorenz et al. | 526/218 |
| 3,933,426 | 1/1976 | Martini et al. | 8/184 |
| 4,052,158 | 10/1977 | Weil | 8/184 |

FOREIGN PATENT DOCUMENTS

| | | | |
|---|---|---|---|
| 618184 | 2/1949 | United Kingdom | 8/186 |

*Primary Examiner*—Joseph L. Schofer
*Assistant Examiner*—Maria S. Tungol
*Attorney, Agent, or Firm*—M. Howard Silverstein; Raymond C. Von Bodungen; David G. McConnel

[57] ABSTRACT

High levels of durable-press appearance rating and conditioned wrinkle recovery angle together with improved abrasion-resistance, breaking strength, and tearing strength are the primary textile qualities imparted to cellulosic textile with aqueous solutions containing N-methylolacrylamide-type reagents, a salt of persulfuric acid, and an alkali metal phosphate, which may be supplemented with standard wetting agents and fabric softeners.

1 Claim, No Drawings

ABRASION RESISTANCE AND STRENGTH OF COTTON-CONTAINING FABRIC MADE RESILIENT WITH N-METHYLOLACRYLAMIDE-TYPE REAGENT

CROSS REFERENCE TO RELATED APPLICATIONS

This application is related to copending application, "Process for Producing Durable-Press Cotton Fabrics with Improved Balances of Textile Properties", by Stanley P. Rowland et al, Ser. No. 8,130.

This is a division of application Ser. No. 8,129, filed Jan. 31, 1979.

BACKGROUND OF THE INVENTION (1) Field of the Invention

This invention relates to the chemical treatment of cellulosic textiles to improve the physical properties. More specifically, this invention pertains to an improved formulation that imparts to cellulosic textiles high levels of resilience in combination with high levels of abrasion resistance, breaking strength, and tearing strength. (2) It is well known to impart durable wrinkle resistance to cellulosic fabrics such as cotton, by impregnation with an aqueous solution of a suitable thermosetting resinous precondensate or cellulose crosslinking agent, usually with appropriate catalyst, and eventually curing the impregnated fabric. Such treatments have been effective in improving the wrinkle resistance and shape-holding properties of cotton fabrics and have resulted in greatly increased demand for "easy-care", "wash-and-wear", and "permanent-press" cotton fabrics because they combine traditional comfort, washability, and economy of native fibers with easy care properties that are desired in today's textile market.

A variety of processes has been developed and used for improving wrinkle resistance or wrinkle recovery of fabrics and garments. These processes are known in general as pad-dry-cure resin treatments, where one or more resins are applied to the fabrics through padding, and the fabrics are partially dried before the resin is cured.

The conventional thermosetting resin systems, either postcured or precured, result in embrittlement and reduction of mobility of the microstructural units of cellulosic fibers to such an extent that abrasion resistance, breaking strength, and tearing strength are seriously impaired. Abrasion resistance is often reduced by 75–80%, breaking strength by 50–60%, and tearing strength about by about 50%.

Over the last several years considerable research has been conducted to find ways of overcoming this problem without compromising the wash-wear or durable-press performance of the fabric. Many variations from the pad-dry-cure process have been developed in attempts to solve the problem. These include processes involving a multistage padding and curing, processes involving a pad and wet-fixation prior to cure, and processes involving polymeric additives. The results achieved through all of these porcesses have been marginal and the processes have often been found to be cumbersome and expensive.

The particularly pertinent prior art relative to this invention starts with U.S. Pat. No. 3,125,405, which includes a summary of the foregoing art. This patent describes a process wherein N-methylolacrylamide is reacted in cotton by vinyl polymerization (i.e., at the $H_2$—C=CH—) and is also reacted with the hydroxyl group of the cellulose molecule (i.e., etherification reaction between the —$CH_2OH$ and the hydroxyl groups of cellulose). This is accomplished by including in the reagent solution a free radical initiator for the vinyl polymerization; this initiator may be acidic in character or acid-generating under the conditions of the curing reaction with cotton, or it can be supplemented with an acid catalyst. In the single-step reaction the N-methylolacrylamide penetrates the fibers, yarns, and fabric and polymerizes to provide long-chain molecules which become attached to cellulosic molecules by means of ether linkages resulting from the reaction of methylol groups in the amide monomer or polymer with the hydroxyl groups of the cellulose. In two alternative processes, the N-methylolacrylamide may be polymerized by vinyl addition with a free-radical initiator before or after reaction is catalyzed by acid between the methylol groups and cellulosic hydroxyl groups. The one-step operation is more efficient for a given amount of reagent, and is preferred for this reason; a one-step operation is substantially more economical and much preferred for textile mill operation. Whether the reaction is conducted in one or two steps, the curing reactions at elevated temperature are conducted at 300° F. for periods of a few minutes. The preferred acid-generating initiators for vinyl polimerization are ammonium and alkali metal persulfates. Acid catalysts are employed together with these persulfate catalysts, or in a separate step there is included a treatment with bisulfate, ammonium chloride, amine salts of hydrochloric or sulfuric acid, or a variety of organic acids.

In U.S. Pat. No. 3,125,406, improved products are indicated to result from the reaction of N-methylolacrylamide with cotton when the reaction is conducted in a special two-stage manner. The preliminary stage involves catalysis with a persulfate catalyst together with an amine-hydrochloride (acid catalyst) and the curing reaction at elevated temperature (90°–175° C.) is carried no further than to reduce the moisture content of the fabric to at least 10% by weight, based on the weight of the dry fabric. This partially reacted fabric is rinsed to remove unreacted N-methylolacrylamide and catalyst residues; the fabric is activated with an acid-generating catalyst (i.e., zinc nitrate, zinc chloride, sodium nitrate, potassium nitrate), which may be supplemented with a salt having high solubility in water, such as sodium or potassium nitrate or calcium bromide. At this point, the fabric is subjected to a second curing reacting at an elevated temperature similar to that of the first cure. The presence of the latter salt is said to enhance the creaseproofing effect for a given amount of acid-generating catalyst. This invention is said to provide products of improved character in that they have better strength, show less discoloration, and are subject to little or no damage as a result of treatments using conventional chlorine or hypochloride bleaching agents and subsequent drying or ironing.

In U.S. Pat. No. 3,246,946 the same improvements in product are said to result from a modification of the process described in U.S. Pat. No. 3,125,405, in which the N-methylolacrylamide is supplemented with limited proportions of N-methylol reagents such as those derived from urea, ethyleneurea, melamine and related compounds. The supplementary N-methylol reagent may be introduced into reaction systems such as those described in U.S. Pat. No. 3,125,405. However, the one-step operation is said to be preferred and generally more efficient for a given amount of reagent.

An improvement in removal of the soiling from the carbon black is claimed in U.S. Pat. No. 3,322,569 wherein cotton fabric is treated with an aqueous solution of a conventional dimethylol reagent (e.g., dimethylolethyleneurea) and a copolymer or butyl acrylate with N-methylolacrylamide, together with low concentrations of N-methylolacrylamide, and a compound containing two polymerizable double bonds such as divinyl benzene or glycol diacrylate.

Three additional patents deal with the reaction of N-methylolacrylamide with cotton fabrics. They are mentioned here to complete the picture, although they are not as pertinent as the foregoing patents.

U.S. Pat. No. 3,558,263 describes a method of inhibiting crosslinking of cellulose when N-methylolacrylamide is reacted with cellulosic textile materials in the presence of an acidic or acid-generating catalyst, e.g., zinc nitrate. In this case potassium iodide (0.1–1.0%) is introduced into the system with or without cupric chloride (ca. 0.1%). In U.S. Pat. No. 3,561,916 a single-step reaction between N-methylolacrylamide and cotton fabric is catalyzed with zinc nitrate to obtain a cotton fabric having high levels of dry wrinkle recovery with low strength loss due to chlorine retention. The process of application of the reagent plus catalyst to fabric in this case is generally similar to that described in U.S. Pat. No. 3,125,405, even though the zinc nitrate catalyst is not known to cause polymerization of the vinyl monomer. In U.S. Pat. No. 3,669,609 citric acid or dicyanamide is added to N-methylolacrylamide to cause a substantial reduction in the yellowing of cellulosic fibers that are treated with this reagent.

The foregoing Prior Art patents fall into one of these categories:

(a) Those that deal with a process or product improvement other than that involving high resilience (durable-press rating and conditioned wrinkle recovery angle) with high retentions of abrasion resistance and strength, or (b) That patent (U.S. Pat. No. 3,125,405) which deals with the combination of high levels of resilience with abrasion resistance and strength, for which results are achieved in a one-step process and for which experimental data will be illustrated in the Examples of the process of the present invention (below).

SUMMARY OF THE INVENTION

This invention provides a chemical formulation and a process for imparting to cotton and other cellulosic textiles and blends of cellulosic with non-cellulosic textiles, high levels of resilience (thus enhancing the durable-press appearance and the wrinkle recovery angle) together with retention of high levels of abrasion resistance, breaking strength, and tearing strength. These qualities are achieved by applying the new formulation by standard wet-processing methods.

The formulation provided by this invention utilizes known N-methylolacrylamide-type reagents and acidic or acid-generating water-soluble initiators for vinyl polymerization or monomers containing $H_2C{=}CH{-}$ units together with an alkali metal phosphate. It is the addition of the latter constituent which is considered the crucial element of the present invention. The formulation can be combined with the ordinary wetting agents and fabric softeners.

The main object of the present invention is to provide a process for improving the wrinkle resistance and smooth drying characteristics of cellulose fiber-containing textiles which process substantially prevents or alleviates the problems of the prior art.

Another object of the present invention is to provide a process for achieving a favorable balance between durable-press or easy-care performance and abrasion resistance of cellulosic textiles.

Yet another object of the present invention is to provide a process for improving the balance between the durable-press or easy-care performance and strength retentions.

DESCRIPTION OF THE PREFERRED EMBODIMENTS

The present invention teaches a process and a chemical formulation which is useful in the textile industry for treating various natural or artificial cellulosic fibers, alone or as mixtures with each other, or as mixtures with synthetic and other fibers, such as for example, cotton, hemp, linen, and regenerated or artificial cellulose fibers, such as the various types of rayon. Other fibers may be used as blends with above mentioned cellulosics. These include wool, silk, polyamides, polyester, acrylics, polyurethances, and cellulose acetate. The preferred cellulosic fiber content in the blended textiles of this invention should be a quantity which computes to be no lower than 30% by weight of the total fiber content. The textile may be a knit, a woven, or a non-woven construction. The formulation and process of this invention are applicable to fibers, yarns, and fabrics, or alternatively, the formulation and process may be applied to fibers and yarns which are programmed for later construction into fabrics, as needed.

The instant invention discloses a process wherein cellulosic fiber-containing materials may be impregnated with aqueous solutions of conventional methylol derivatives of acids containing vinyl polymerizable units, a water-soluble acid-generating, free-radical initiator, either disodium hydrogen phosphate or a mixture of it with sodium hydrogen phosphate (or equivalent potassium salts), and supplementary components conventionally employed in finishing cotton, cured with or without prior drying, and that the resulting fibers or textile products have high resilience combined with high retention of abrasion resistance, breaking strength and tearing strength. The essence of this discovery may be stated as follows: Durable-press or easy care fabrics characterized by high levels of retentions of abrasion resistance and strength properties can be produced by reacting cellulosic textiles with N-methylolacrylamide-type reagent in combination with an inorganic persulfate and alkali metal phosphate salts.

In this regard, foregoing terms may be defined as follows: Durable-press is defined as good smooth-drying appearance, and excellent retention of shape as measured primarily by conditioned wrinkle recovery angle and durable-press appearance rating. Durable-press properties are generally imparted to cellulosic fabrics by reactions which form crosslinks in the cellulosic fiber. Retention of strength is measured on experimentally-treated samples and compared to the strength of unmodified fabric; in this connection, breaking strength and tearing strength are measured in the conventional manner. Retention of abrasion resistance also involves a comparison of the results obtained on the experimentally-treated fabric relative to those obtained on the initial unmodified fabric; tests appropriate for the estimation of abrasion resistance are the Stoll flex abrasion resistance test and the Accelerator weight loss test. In the latter case results are expressed as Accelerotor weight retention so that all high numbers refer to the more attractive performance properties.

In the process of the invention, the methylol reagent may serve the usual function, i.e., that of undergoing etherification reactions with the cellulosic substrate for formation of crosslinks and development of resilience. However, in this particular case it also has an additional function in that the $H_2C{=}CH-$ undergoes vinyl-type polymerization to form a long carbon chain. The persulfate initiator supplies a source of free radicals, which cause $H_2C{=}CH-$units to undergo polymerization within the cotton fiber; the same free-radical initiator is adequate to promote the etherification reaction of the methylol reagent with cellulose without necessity for introduction of a supplementary conventional salt or acid-generating catalyst. Methylenebisacrylamide may be applied advantageously in some respects in connection with the foregoing reagents; this water-soluble difunctional vinyl monomer may be introduced to contribute to durability of the vinyl polymer over the life time use of the fabric. It constitutes an optional, although sometimes desirable, addition to the reagent system. Comments relative to the inorganic phosphate salts are made in the following paragraph. Supplementary components may be introduced into the reagent system for conventional purposes: wetting agents, softening agents and in water-soluble ion exchange or complexing agents.

The contribution of the alkali metal phosphate salts is not clearly understood. These materials are commonly considered to be buffering agents, yet they exert more than this type of effect on the reaction of N-methylolacrylamide-type reagents with cotton cellulose. As the concentration of a phosphate salt or a combination of phosphate salts is increased in the reaction mixture that is applied to cotton, there is, at first, little or no effect of these salts on resilience achieved in the curing reaction. There is, however, a decided increase in the retention of abrasion resistance and strength properties. At some particular level of concentration of phosphate salt or combination of phosphate salts that is characteristic of the treating system and the combination of salts, there is a drastic drop in the level of resilience that is achieved in the final product. It is further established by the instant inventors that the presence of phosphate salts decelerates the reaction of the methylol group of these acrylamide-type reagents, but the deceleration is small and reaction is completed within the normal time allowed for cure at elevated temperature. The presence of phosphate salts appears to accelerate the vinyl polymerization of the N-methylolacrylamide-type monomers as measured by gel time of the reagent systems. Although only traces of phosphorus, at most, are found in the final product after laundering, the phosphate salts contribute to an elevated level of moisture regain and of water of imbibition of the final cotton products; these are hydrophilic characteristics that are considered to have a contribution to improved comfort of cotton textile products. In the fibers of the final cotton product, there is an indication of a more open crosslinked structure than that characterized from the conventional finishing reactions that are carried to the same high level of resilience as those achieved with N-methlolacrylamide-type systems that involve phosphate salts.

A specific example of the preferred embodiment of the reagent system is as follows:

FORMULA OF FINISHING REAGENT SYSTEM

| Chemical Component | Percentage by Weight |
|---|---|
| N-methylolacrylamide-type Reagent | 4.0–25.0 |
| Persulfate Initiator | 0.2–4.0 |
| Alkali Metal Phosphate | 0.1–4.0 |
| Methylenebisacrylamide | 0.0–1.0 |
| Supplementary Components* | 0.5–5.0 |
| Water | To bring total to 100 |

*Such as wetting agent, softening agent, heavy metal complexing agent, soil release agent, etc.

The N-methylolacrylamide-type reagent may be N-methylolacrylamide, N-methylolmethacrylamide, or N-methylolitaconamide. Other conventional reagents may be added; these include dimethylolethyleneurea, dimethyloldihydroxyethyleneurea, methylolmelamine, methylated methylolmelamine, methylolated urea formaldehyde reagents, methylolated carbamates, methylolurons, dimethololpropyleneurea, and methyloltriazones.

The persulfate initiator may be selected from among various inorganic salts of persulfuric acid, preferrably ammonium persulfate, sodium persulfate, and potassium persulfate. Other free radical generators, such as alkali metal salts of carboxyl-containing azo compounds may be employed provided they are supplemented with acidic or acid-generating metal salts; a specific example is sodium 4,4' azobis (4-cyanovalerate) when supplemented with acidic salts such as ammonium or sodium hydrogen sulfate or when supplemented with acid-generating salts such as magnesium chloride or aluminum chlorhydroxide.

The alkali metal phosphate salts include disodium and dipotassium hydrogen phosphate. Either of these may be used alone to obtain attractive results. Similarly, monosodium or monopotassium dihydrogen phosphate may be employed as the sole phosphate during the chemical finishing reaction. It is preferred, however, to employ a mixture of monohydrogen and dihydrogen phosphate in approximately equimolar ratio and to use a total concentration of phosphate such that there is little loss in resilience as a result of presence of phosphate but there is substantial gain in retention of abrasion resistance and strength properties. This is usually realized at a concentration of phosphate in the range of 0.1–4.0%, but it depends to some extent upon the specific N-methylolacrylamide-type reagent that is employed in the reaction, upon the specific pH value to which this reagent has been adjusted following the methylolation reaction, and upon the amount and type (alkali metal or ammonium) of persulfate initiator.

Methylenebisacrylamide, although not critical to the operation of this invention may be advantageously employed under certain circumstances.

Depending upon a specific situation, it may be desirable to introduce conventional agents that are employed in textile finishing for specific purposes; for example, small amounts of wetting agents are advantageous in most cases where speed of wetting is an important factor. Softening agents exemplified by emulsions of low molecular weight polyethylenes are beneficial in the conventional manner of providing a pleasant hand to the fabric.

After the cellulosic textile is impregnated with the reagent solution, it may be stored in the wet state or subjected to a drying process. The impregnated and dried textile is subjected to a curing which consist of high temperature treatment carried out in an oven or with an apparatus which supplies a controlled amount of heat to the fabric. The curing step or steps may be conducted over a range of temperature between 100° and 200° C., for times varying from a few seconds to many minutes in inverse proportion to the temperature of the heating medium (e.g., air or metal surface).

The preferred curing conditions are those which limit access of oxygen to the fabric with or without the presence of steam at temperatures in the range of 140°–200° C. for a period of 0.5–5 minutes. It is however, satisfactory to employ the same conditions of heating in the presence of air, although under these conditions the curing time may be shortened. After the final cure, the fabric may be stored in this stage or it may be converted into garments; the fabric may also be subjected to a process wash to remove small amounts of components that have not undergone fixation into the cellulosic fibers.

Products of the instant invention are characterized by high levels of textile properties and attractive balances of these properties. On a fabric of specific construction and weight, the process of this invention results in superior products (compare 3.5 oz./sq.yd 80×80 printcloth of Examples 1–3 vs. 8 oz./sq.yd. twill of Example 4).

TESTING METHODS EMPLOYED

The following textile test methods were employed: Durable-press appearance ratings after one laundering and tumble-drying cycle by AATCC Test Method 124-1967, conditioned and wet wrinkle recovery angle with the Monsanto Tester by ASTM D1295-67, breaking strength and elongation by the strip (1-in.) method according to ASTM D1682-64, tearing strength by ASTM D1424-63, Stoll flex abrasion resistance by ASTM D1175-55T(b), and Accelerotor abrasion resistnace by AATCC test method 93-1974.

The method of testing the treated textiles is, of course correlated to the objectives of the invention. For that reason, again it must be pointed out that the essence of the present invention is the discovery that as a result of the chemical reaction of N-methylolacrylamide-type reagent that is initiated and catalyzed by ammonium or alkali metal persulfates in the presence of certain concentrations of alkali metal phosphates, attractively high resilience can be obtained together with unusually high retentions of abrasion resistance, breaking strength, and tearing strength in the chemically modified cotton fabric. By controlling the amounts and proportions of the various components, and especially the alkali metal phosphate salts, the performance qualities of the chemically-modified cotton fabric can be made to cover a wide range of improved levels of abrasion resistance and strength properties together with high durable press ratings and conditioned wrinkle recoveries.

The following examples are provided to illustrate the preferred embodiments of the present invention. This is not meant to limit the scope of the present invention in any manner whatever.

EXAMPLE 1

Cotton 80×80 printcloth was impregnated to about 93% wet pickup with a solution containing 10% of N-methylolacrylamide (NMA), 0.5% of ammonium persulfate, 1.0% of methylenebisacrylamide, 0.1% of Triton X-100 (wetting agent), and 6.65% of a commercial polyethylene softening agent containing 17% active component. Samples of fabric were placed on pin-frames, dried four minutes at 85° C., placed in heat-resistance plastic bags which were flushed with nitrogen, cured for five minutes at 160° C., laundered with AATCC detergent 124 in an automatic washing machine, and tumble dried for 30 minutes (to dryness) in an electric tumble dryer. The product from this reaction is designated 1*a* and results are listed in Table I. Identical reactions were carried out on cotton fabric with increasing amounts of $KH_2PO_4$ and $Na_2HPO_4$; present in the reaction mixture: 1*b*, 0.13% of each $KH_2PO_4$ and $Na_2HPO_4$; 1*c*, 0.26% of each $KH_2PO_4$ and $Na_2HPO_4$; and 1*d*, 0.52% of each $KH_2PO_4$ and $Na_2HPO_4$. Results that are summarized in Table I show that products resulting from reactions involving phosphate salts exhibit essentially equivalent resilience and wrinkle recovery angles (WRA) to the product resulting from reaction in the absence of phosphate salts. Moreover, the former products exhibit increases in retention of abrasion resistance and strength in direct proportion to the concentration of phosphate salts.

TABLE I

| NO. | DP RATING | WRA, COND. | (W + F)° WET | BREAKING STRENGTH % RETAINED | TEARING STRENGTH % RETAINED | STOLL FLEX ABRASION, % RETAINED | ACCELEROTOR ABRASION % WT RETAINED |
|---|---|---|---|---|---|---|---|
| 1a | 4.3 | 304 | 239 | 55 | 82 | 23 | 85.8 |
| 1b | 4.4 | 305 | 238 | 58 | 87 | 43 | 87.0 |
| 1c | 4.5 | 301 | 248 | 61 | 87 | 46 | 89.3 |
| 1d | 4.5 | 301 | 235 | 61 | 91 | 62 | 91.7 |
| orig. fabric | 1.6 | 201 | 164 | 100 | 100 | 100 | 99.2–99.5 |

EXAMPLE 2

In the same manner as described in Example 1, cotton fabric was treated with a solution containing 10% of NMA, 0.5% of ammonium persulfate, 1.1% solids of polyethylene softener, and 0.1% of Triton X-100. The fabric was processed as in Example 1: Sample 2a refers to the product resulting from the process involving no phosphate salts; 2b, 0.78% $Na_2HPO_4.12H_2O$; 2c, 1.1% phosphate salt; 2d, 1.57% phosphate salt; 2e, 2.36% phosphate salt. Sample designated 2f refers to the original unmodified fabric. The results that are tabulated in Table II show that this phosphate salt contributes to an improvement in the product resulting from reaction up through a concentration of 1.57% of $Na_2HPO_4.12H_2O$.

TABLE II

| NO. | DP RATING | WRA, COND. | (W + F)° WET | BREAKING STRENGTH % RETAINED | TEARING STRENGTH % RETAINED | STOLL FLEX ABRASION, % RETAINED | ACCELEROTOR ABRASION % WT RETAINED |
|---|---|---|---|---|---|---|---|
| 2a | 4.4 | 302 | 246 | 50.6 | 65.7 | 48.1 | 91.4 |
| 2b | 4.4 | 295 | 230 | 53.4 | 64.9 | 71.6 | 91.6 |
| 2c | 4.3 | 298 | 236 | 51.7 | 67.9 | 105.6 | 93.5 |
| 2d | 4.3 | 293 | 222 | 53.4 | 79.1 | 117.8 | 94.9 |
| 2e | 3.9 | 284 | 205 | 57.2 | 83.6 | 215.1 | 96.3 |
| 2f | 1.4 | 194 | 155 | 100 | 100 | 100 | 99.3 |

EXAMPLE 3

Cotton printcloth was impregnated to about 100% wet pickup with a solution containing 11% of N-methylolmethacrylamide, 0.5% methylenebisacrylamide, 1% solids of polyethylene softener, 0.4% wetting agent, 0.5% ammonium persulfate, and phosphate salts as indicated below: Sample 3a, 0.14% each $KH_2PO_4$ and $Na_2HPO_4$; 3b, 0.35% of each of the phosphate salts; 3c, 0.70% of each of the phosphate salts; 3d, 1.10% of each phosphate salt; and 3e, no phosphate salts.

Samples of the impregnated fabric were placed on pinframes, dried at 85° C. for four minutes, and cured under nitrogen in heat-resistant plastic bags at 160° C. for five minutes. Samples of fabric were laundered and tumble dried before textile evaluation, which is summarized in Table III. Results in this table show that abrasion resistance and strength increase progressively with addition of phosphate salts, that durable-press appearance rating decreased slightly with the first two additions of phosphate salt and very substantially with the fourth addition.

TABLE III

| NO | DP RATING | WRA, COND. | (W + F)° WET | BREAKING STRENGTH % RETAINED | TEARING STRENGTH % RETAINED | STOLL FLEX ABRASION, % RETAINED | ACCELEROTOR ABRASION % WT RETAINED |
|---|---|---|---|---|---|---|---|
| 3a | 4.8 | 284 | 230 | 52.6 | 60.5 | 72 | 97.0 |
| 3b | 4.6 | 285 | 229 | 52.2 | 59.2 | 83 | 97.6 |
| 3c | 4.1 | 279 | 225 | 56.6 | 62.7 | 134 | 98.5 |
| 3d | 3.3 | 281 | 214 | 66.2 | 70.4 | 178 | 99.2 |
| 3e | 4.9 | 300 | 241 | 46.0 | 56.3 | 52 | 95.0 |
| Unmodified Fabric | 1.5 | 195 | 214 | 100 | 100 | 100 | 100 |

EXAMPLE 4

Following the general procedure of the preceeding example, 3/1 white cotton twill fabric was treated with a solution containing 12% N-methylolmethacrylamide, 0.5% methylenebisacrylamide, 1.0% solids of polyethylene softener, 0.4% wetting agent, 0.5% ammonium persulfate, and phosphate salts as indicated below: In this case, the wet pickup was approximately 80%. Impregnated fabric was dried at 70° C. for eight minutes and cured in air at 160° for three minutes. Phosphate slats were employed as follows: 4a, 0.0% concentration; 4b, 0.35% of each $KH_2PO_4$ and $Na_2HPO_4$; 4c, 0.70% of each salt; 4d, 1.10% of each salt; and 4e, unmodified cotton fabric. Results summarized in Table IV illustrate the effectiveness of phosphates for curing reactions in the presence of air.

TABLE IV

| NO. | DP RATING | WRA, COND. | (W + F)° WET | BREAKING STRENGTH % RETAINED | TEARING STRENGTH % RETAINED | STOLL FLEX ABRASION, % RETAINED | ACCELEROTOR ABRASION % WT RETAINED |
|---|---|---|---|---|---|---|---|
| 4a | 4.9 | 231 | 181 | 70.0 | 79.3 | 123 | 98.2 |
| 4b | 4.8 | 227 | 178 | 76.7 | 84.7 | 156 | 94.6 |
| 4c | 4.8 | 223 | 173 | 74.2 | 84.2 | 143 | 98.2 |
| 4d | 4.6 | 222 | 185 | 74.0 | 84.2 | 154 | 98.5 |
| 4e | 1.5 | 164 | 157 | 100 | 100 | 100 | 100 |

OBSERVATIONS

In the results summarized in the foregoing examples, it is evident that resilience, as measured in durable-press appearance rating and wrinkle recovery angles, drops off for those cotton fabrics which were reacted with reagent systems containing the highest levels of phosphate salts. Additional higher levels of phosphate salts may be employed in the manner as indicated above without further advantage in balance of textile properties. However, when both the persulfate initiator and the phosphate salts are increased proportionately in concentration, attractive balances of resilience, strength, and abrasion resistance are realized. For example, the persulfate initiator may be raised to 1.25% with each of the phosphate salts raised proportionately to higher concentrations such as 0.74% to 3.75%. The ratio of dihydrogenphosphate salt to monohydrogen phosphate salt may be varied over a relatively broad range. Whereas Example 1 illustrates an equimolar mixture of two salts, Example 2 illustrates the effectiveness of the monohydrogen phosphate, alone. Rather than varying the ratio of these two salts from 1:0 to 0:1, it is acceptable to add sodium hydroxide to $KH_2PO_4$ to obtain a combination of phosphates. Likewise, one may add phosphoric acid to NaOH to obtain suitable phosphate salts formed in situ. Concentrations of N-methylolacrylamide-type reagents may be varied over a broad range to achieve various levels of add-on reagent and various levels of resilience. In such cases, the simple and general approach is to change the concentrations of other components in proportion to the change in concentration of N-methylolacrylamide-type reagent. When an alkali metal persulfate is employed as the free-radical initiator, lower weight ratios of phosphate salts to initiator are effective in accomplishing the same purposes illustrated above with ammonium persulfate.

We claim:

1. A chemical composition for imparting to cellulosic textiles high levels of resilience together with retention of high levels of abrasion resistance, breaking strength, and tearing strength, the composition comprising 4% to 50% aqueous solution containing about from 4% to 25% of N-methylol reagent selected from the group consisting of N-methylolacrylamide, N-methylolmethacrylamide, and N-methylolitaconamide; about from 0.2% to 4.0% of an acidic water-soluble initiator for vinyl polymerization of monomers containing $H_2C{=}CH-$ units, the initiator selected from the group consisting of ammonium or alkali metal persulfates; and about from 0.1% to 4.0% of an alkali metal phosphate or combination of phosphates selected from the group consisting of disodium hydrogen phosphate,
dipotassium dihydrogen phosphate, and
potassium dihydrogen phosphate, and
sodium dihydrogen phosphate.

* * * * *